United States Patent [19]

Fishburn

[11] 4,236,542

[45] Dec. 2, 1980

[54] ROTATING FASTENER MECHANISM FOR HOLDING A WORKPIECE IN A WASHING APPARATUS

[75] Inventor: Charles E. Fishburn, Indianapolis, Ind.

[73] Assignee: National Printing Plate Company, Inc., Indianapolis, Ind.

[21] Appl. No.: 972,980

[22] Filed: Dec. 26, 1978

[51] Int. Cl.[3] ..... B08B 3/02

[52] U.S. Cl. ..... 134/153; 134/156; 134/160; 134/162; 211/202; 248/277; 254/122; 269/254 R

[58] Field of Search ..... 134/143, 140, 149, 153, 134/156, 158, 160, 162, 200; 269/254 R; 118/500-503; 211/89, 202; 288/277; 254/122

[56] References Cited

U.S. PATENT DOCUMENTS

| | | | |
|---|---|---|---|
| 750,756 | 1/1904 | Eklund | 269/254 R X |
| 2,277,919 | 3/1942 | Liptak | 134/162 X |
| 3,088,391 | 5/1963 | Sigler | 134/153 X |
| 3,136,671 | 6/1964 | Martz et al. | 134/162 X |
| 3,182,671 | 5/1965 | Vorie | 134/153 X |
| 3,251,521 | 5/1966 | Fay | 211/202 X |
| 3,291,431 | 12/1966 | Daniel, Jr. | 248/277 |

*Primary Examiner*—Robert L. Bleutge

*Attorney, Agent, or Firm*—Jenkins, Coffey, Hyland, Badger and Conard

[57] ABSTRACT

A rotatable fastener for holding a workpiece includes a plurality of arm members each pivotally coupled to at least two others of the arm members for scissoring movement, at least two grips situated at extremities of the arm members, and at least one tension spring coupled to the arm members for biasing the grips inwardly towards each other, thereby forcing the grips to engage the workpiece and hold same. The arm members are pivotally mounted to a rotating hub having drive posts for rotating the arm members and the grips include fingers extending angularly from a base portion thereof for receiving workpieces of various shapes, sizes, and thicknesses.

17 Claims, 5 Drawing Figures

ROTATING FASTENER MECHANISM FOR HOLDING A WORKPIECE IN A WASHING APPARATUS

The present invention relates generally to mechanisms for holding a workpiece, and more particularly to such mechanisms which are rotatable and capable of accommodating workpieces of various shapes, sizes, and thicknesses where the workpieces are easily and quickly inserted in and removed from the mechanism.

Heretofore, fastener mechanisms for holding a workpiece have been limited with respect to their use because of the various steps involved in inserting and securing the workpiece in the mechanism, and removing it once the work is completed. Previously, the workpiece would have to be inserted and removed by disengaging a number of clamping devices associated with the fastener mechanism, and a new workpiece placed in position with a re-engagement of the clamping devices. These steps have typically consumed a considerable amount of time and have required at least both hands of one individual, and many times two individuals, to accomplish. Where time and manpower utilization are not of importance, the use of these previous mechanisms have been acceptable; however, where time and manpower utilization are important, these previous mechanisms have been unacceptable.

Furthermore, previous fastener mechanisms have been capable of accommodating only limited shapes and types of workpieces. While some prior fastener mechanisms might provide for various lengths and widths of workpieces, they frequently did not provide for various thicknesses of the workpiece or vice versa. In addition, fastener mechanisms heretofore known have neither been rotatable for allowing access to the complete workpiece nor have they been designed to be self-aligning upon removal of a workpiece and to receive the next workpiece.

The disadvantages described above which are associated with prior fastener mechanisms are particularly undesirable in uses such as wash-out machines, paint spray booths or any other applications where a quick insertion and release of the workpiece is important and the workpiece must be rotated while being held to expose all areas of the workpiece to the work being performed.

A wash-out machine typically includes a compartment within which a workpiece is placed and a plurality of nozzles for providing a liquid spray to wash the workpiece. It is advantageous to have a fastener mechanism for holding the workpiece which allows for quick insertion and release of the workpiece. This is of particular importance where the liquid used, e.g. acid, produces dangerous fumes and, therefore, the time during which the compartment is open should be minimized. It is thus advantageous to have a fastener mechanism which is rotatable to allow the liquid spray to thoroughly and completely wash the workpiece, which is capable of accommodating a variety of sizes and shapes of workpieces and which is capable of being operated by a single individual.

In accordance with the present invention, there is provided a mechanism for holding a workpiece which includes a plurality of arm members pivotally connected together and carrying workpiece retaining means coupled to the arm members and capable of a variably spaced interval in response to scissoring movement of the arm members to grip and retain workpieces of differing dimensions. The mechanism can include a plurality of inner and outer arm members pivotally coupled together in a lazy tong configuration for extension and contraction of the mechanism by scissoring movement with workpiece engaging means coupled to the outer arm members to engage the workpiece and to retain it in response to means urging the contraction of the mechanism, and means for rotating the plurality of arm members and the retained workpiece to provide accessibility to various portions of the workpiece.

Accordingly, it is a feature of the present invention to provide a fastener mechanism as described hereinabove which allows a single user thereof to quickly insert and release the workpiece, frequently with one hand, such that the time required to remove completed workpieces and insert new workpieces is minimized.

It is a further feature of the present invention to provide a mechanism for holding a workpiece wherein means for retaining the workpiece allow the mechanism to accommodate various shapes, sizes, and thicknesses of workpieces. Another feature of the present invention is to provide a rotatable mechanism for holding a workpiece and centering it for rotation, thereby allowing easy and complete access to the total workpiece.

Yet another feature of the present invention is to provide a fastener mechanism as described hereinabove which is adapted for use in an operating environment in which a quick insertion and release of the workpiece is required and the workpiece can be rotated for exposure of all areas thereof to the work being performed.

Other features and advantages of the present invention will be apparent from the following detailed description of a preferred embodiment thereof, which description should be considered in conjunction with the accompanying drawings in which.

Figure 2:
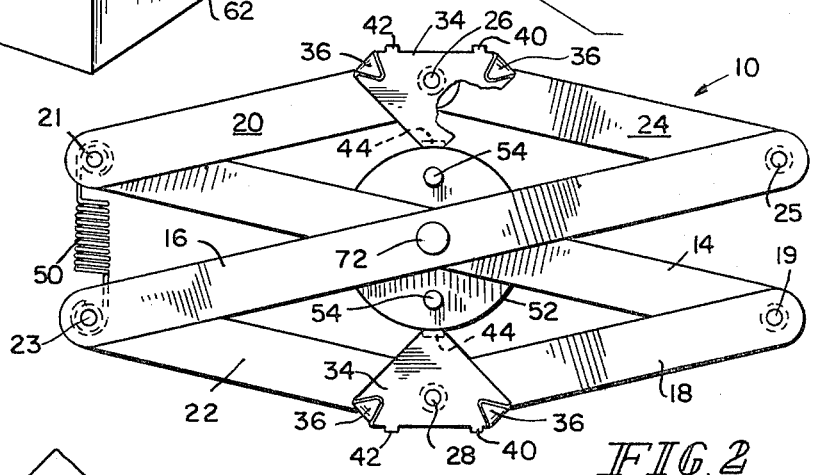
FIG. 2 is an elevational view of the fastener mechanism shown in FIG. 1, with the workpiece removed.
Figure 1:
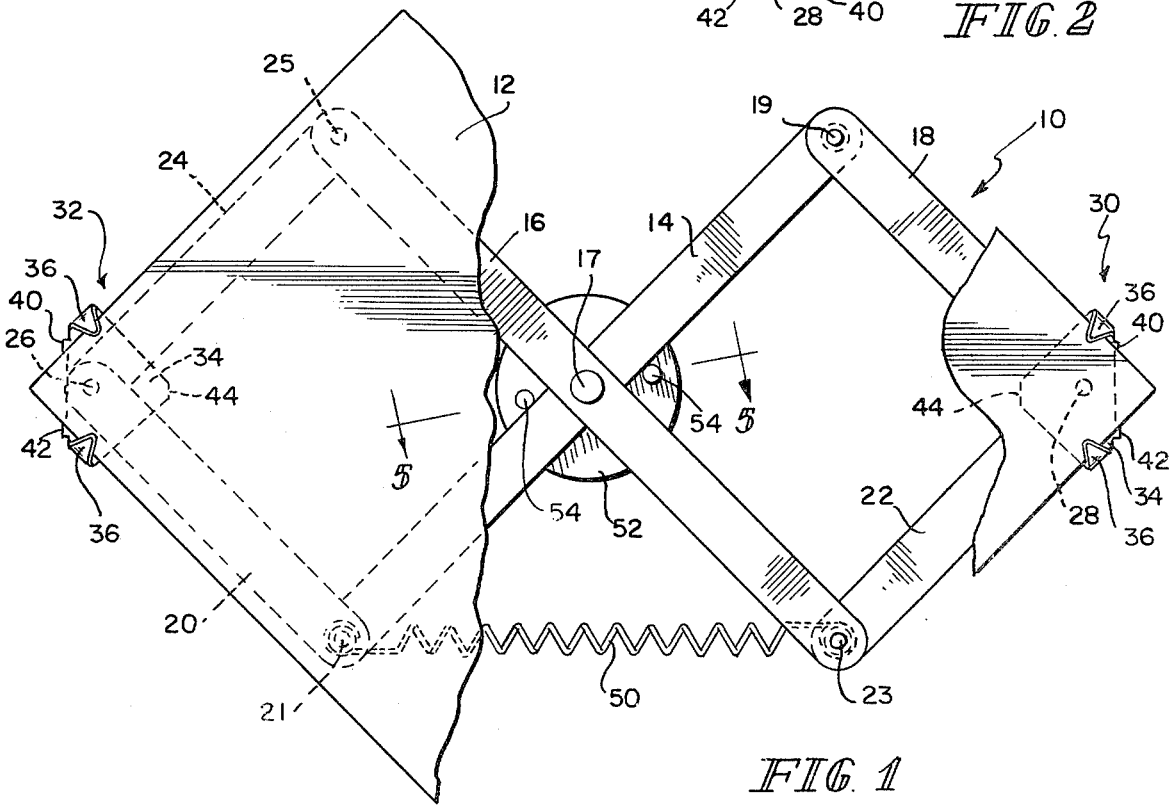
FIG. 1 is an elevational view of a fastener mechanism constructed in accordance with the present invention illustrated with a workpiece inserted therein.

Referring to FIGS. 1 and 2, there is illustrated a rotatable fastener mechanism 10 for holding a workpiece 12 wherein the workpiece is easily and quickly inserted in and removable from the mechanism 10 and may be of various shapes, sizes, and thicknesses. As shown in FIGS. 1 and 2, such a mechanism includes a plurality of arm members 14, 16, 18, 20, 22, and 24 pivotally connected together as at pivot points 17, 19, 21, 23, 25, 26, and 28. So connected together, the lazy tong configuration of the plurality of arms permits the mechanism to be expanded and contracted. The work retention means includes a pair of work engaging means 34 that are carried by the mechanism at pivot points 26 and 28 of the outer arms 20, 24 and 18, 22, respectively, and means 50 urging contraction of the mechanism. As shown in FIG. 1, a workpiece 12 may be easily inserted into the mechanism by engaging one work engaging means 34 and expanding the mechanism until the workpiece 12 may be engaged by the other work engaging means 34. The interval between the work engaging means 34 is then permitted to decrease as the mechanism is contracted under the influence of means 50, thus retaining the workpiece 12 in the mechanism.

The mechanism expands and contracts by scissoring movement of its arm members. By scissoring movement, I mean the counter-rotation of levers or arms about a pivot point that pivotally connects them together, as for example the scissoring movement of the inner arms 14 and 16 of the mechanism as it expands and contracts.

Thus, as shown, mechanism 10 includes a plurality of arm members 14, 16, 18, 20, 22, and 24, each of which are pivotally coupled to at least two other arm members at their respective ends 19, 21, 23, 25, 26, and 28. Although the arm members 14, 16, 18, 20, 22, and 24 may be constructed of materials other than stainless steel, the use of stainless steel material has been found to be advantageous because of its insensitivity to the caustic properties of a variety of liquids and other environmental conditions.

The first and second inner arm members 14 and 16 are pivotally coupled at substantially their centers 17 in a manner which allows them to rotate about each other. Third and fourth outer arm members, 18 and 20 respectively, are each pivotally coupled end-to-end, 19 and 21 respectively, to the first arm member 14. Fifth and sixth outer arm members, 22 and 24 respectively, are each pivotally coupled end-to-end, 23 and 25, respectively, to the second arm member 16. In turn, the third and fifth outer arm members 18 and 22 are pivotally coupled end-to-end 28 to each other and the fourth and sixth arm outer members 20 and 24 are pivotally coupled end-to-end 26 to each other whereby counter-rotation of first and second arm members 14 and 16 about their centers 17 results in either expansion or contraction of the arm members 14, 16, 18, 20, 22, and 24 in a scissoring type movement. This scissoring movement is better illustrated by comparing the different positions of the arm members shown in FIGS. 1 and 2.

Although not specifically shown in FIGS. 1 and 2, arm members 14, 16, 18, 20, 22, and 24 can provide a support for the workpiece 12 when inserted in the mechanism 10. Accordingly, while the workpiece 12 must be of sufficient rigidity to prevent it from collapsing in response to stresses placed thereon by mechanism 10, workpieces of slight rigidity are kept from bowing by the support given to them by arm members 14, 16, 18, 20, 22, and 24.

Importantly, it should be noted that the outer arm members 18, 20, 22, and 24, respectively, are of a shorter length than the inner arm members 14 and 16. The difference in length allows the fastener mechanism 10 to contract completely when the workpiece 12 is removed therefrom. If arm members 18, 20, 22, and 24 were of substantially the same or greater length than arm members 14 and 16, the ability of mechanism 10 to accommodate a large variety of shapes and sizes of workpieces 12 would be limited.

Mechanism 10 further includes means for retaining the workpiece 12 in a position in response to the scissoring movement of the arm members 14, 16, 18, 20, 22, and 24. The retaining means is comprised of two work engaging grips 34 pivotally mounted at extreme locations 30 and 32 on outer arm members 18, 20, 22, and 24 and a restraining means or tension spring 50 for biasing the grips 34 inwardly towards each other and towards the pivotal center 17 of inner arm members 14 and 16. Accordingly, as shown in FIG. 1, arm members 14, 16, 18, 20, 22, and 24 are physically expandable in accordance with the scissoring movement thereof whereby a workpiece 12 is insertable and held in position by grips 34 which are forced towards each other by the tension spring 50 to forcibly engage the workpiece 12. These expanding and forced contracting scissoring movements allow the mechanism 10 to accomodate a variety of shapes and sizes of workpieces 12. Again, the biased or forced contracting scissoring movement of mechanism 10 is best illustrated by referring to FIG. 2 where the mechanism 10 is shown in its biased or contracted position after the workpiece 12 has been removed.

Figure 3:
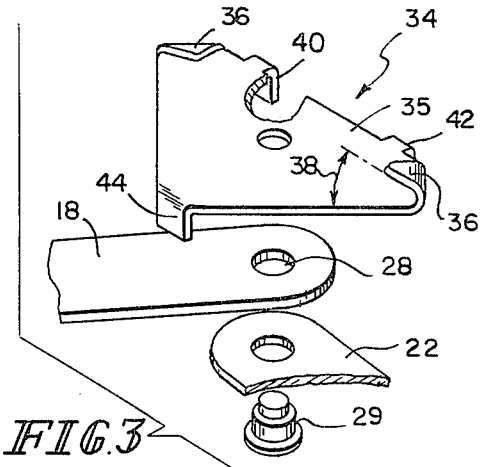
FIG. 3 is an exploded sectional view of the fastener mechanism shown in FIGS. 1 and 2.

Referring now specifically to FIG. 3, and generally to FIGS. 1 and 2, a sectional view of the work engaging means 34 is exploded to illustrate in more detail the various features of the work engaging grips 34. Each grip 34 includes a triangular shaped base 35 which has extending therefrom a plurality of fingers 36, 40, 42, and 44. Fingers 36 each extend angularly from two corners of the base 35 and in fact may be formed by curling the two corners of base 35 upward to a desired angle. In the preferred embodiment of mechanism 10, a substantially 60° include angle 38 is formed by the base 35. Fingers 36 are curled such that workpiece 12 of various thicknesses may be grasped and retained by the fingers 36. Extending downwardly at an angle of substantially 90° from one side of the triangular base 35 are two stop limit fingers 40 and 42 which prevent the work engaging means 34 from rotating about their pivotal mounting by engaging the outer arm members 18, 22, 20, and 24. Accordingly, the work engaging means 34 are self-aligned and self-centered after each workpiece 12 is removed and are therefore ready to receive the next workpiece 12. Importantly, these features increase the speed with which the user of the fastener mechanism 10 may remove and insert workpieces 12.

Continuing to refer to FIG. 3 in conjunction with FIG. 2, another stop limit finger 44 extends downwardly at an angle of substantially 90° from the remaining corner of the triangular base 35. As illustrated in FIG. 2, upon collapsing or contracting of mechanism 10 in respect to removal of workpiece 12, finger 44 will engage a portion of the mechanism 10 such as the base or hub 52 supporting the mechanism 10 to thereby prevent it from completely collapsing and allow sufficient distance between the grips 34 such that a new workpiece 12 may be easily and quickly inserted.

Continuing to refer to FIG. 3, the outer arm members, for example arm members 18 and 22, may be pivotally coupled to each other as previously described by utilizing any of a number of conventional pivot connector pins or pivot posts. As illustrated in FIG. 3, a pivot post 29 is preferred for pivotally coupling the arm members 18 and 22 to each other and pivotally mounting thereto the work engaging means 34. The open end of the pivot post 29 may be stored or flattened to provide a pivot connection capable of withstanding various forces applied to the work engaging means 34 in the operation of fastener mechanism 10.

Figure 4:
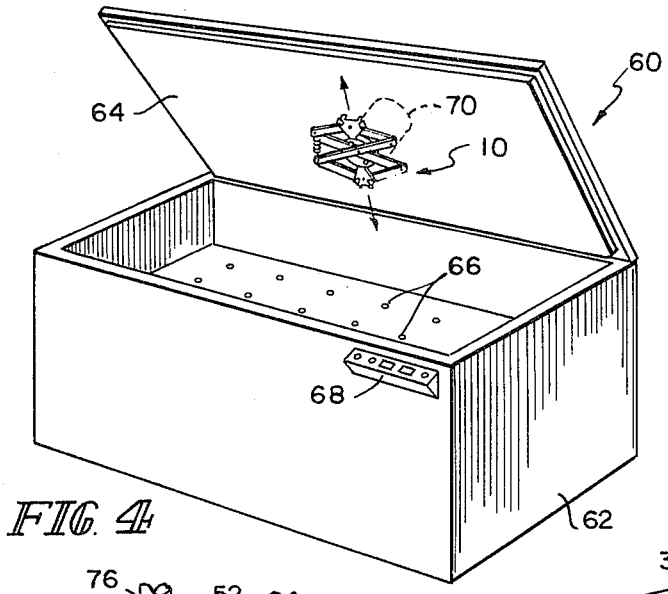
FIG. 4 is an isometric view of an apparatus employing the fastener mechanism shown in FIGS. 1, 2, and 3.

Referring back to FIG. 1, tension spring 50 for biasing grips 34 inwardly towards each other and towards the center 17 of first and second arm members 14 and 16, respectively, is connected to the connection point 21 of first and fourth arm members 14 and 20 respectively and to the connection point 23 of second and fifth arm members 16 and 22 thereby also biasing the connection points 21 and 23 towards each other. The tension of spring 50 should be sufficient to prevent the mechanism 10 from expanding during rotation thereof due to centrifugal forces which would cause the workpiece 12 to fall out of the mechanism 10. In wash-out apparatus such as illustrated in FIG. 4, the speed of rotation is not necessarily fast, and accordingly, the centrifugal forces imposed on the mechanism by such rotation may not be a significant factor. A second tension spring 50 may be connected to the connection point 19 of first and third arm members 14 and 18, respectively, and to the connection point 25 of second and sixth arm members 16 and 24, respectively, thereby providing additional retention force to work engaging means 34.

Continuing to refer to FIG. 1, a rotatable base or hub 52 is pivotally coupled to the centers 17 of first and second inner arm members 14 and 16, respectively. As will be described in more detail hereinafter, the hub 52 may in turn be coupled to a conventional motor 70 (FIG. 4) so that the hub 52 can be rotated. Provided on the hub 52 are two protruding drive posts 54, each situated such that when hub 54 is rotated they engage the outer arms permitting the mechanism 10 to rotate.

Referring now to FIG. 4, there is shown an application of the rotating fastener mechanism 10 of the invention. In the formation of printing plates, plates may be formed by etching a reproduction of a desired image into a plate. This can be accomplished by using a light sensitive emulsion which is exposed to the image in light to fix the image in the light sensitive emulsion, and thereafter washing the exposed plate with a liquid spray consisting of either water or acid to remove the emulsion and to form the desired image in the surface of the plate.

A conventional wash-out machine 60 is shown in FIG. 4 which includes a compartment 62 having a lid or cover 64 for closing and sealing the compartment 62 during the washing process, a plurality of nozzles 66 for providing a liquid spray to wash the emulsion as described above, and a control 68 situated in proximity to the compartment for controlling the operation of the machine 60. Previously, fasteners have been located in the lid 64 of the wash-out machine 60 to hold the plate in position while it was exposed to the washing action of the spray. However, as described, these conventional fasteners have not proven to be satisfactory due to the length of time required to change the plate and the fact that some portions of the plate were not being completely washed. Accordingly, as illustrated in FIG. 4, a rotatable fastener mechanism 10 can be situated in the lid 64 of wash-out machine 60 and coupled to a conventional motor to provide continuous rotation of the fastener mechanism 10. The ease and quickness of use associated with fastener mechanism 10 in addition to its rotational feature make its use in the above-described wash-out machine 60 and process particularly advantageous.

FIG. 4 illustrates a preferred embodiment including the rotatable fastener mechanism 10 of the present invention. Other such uses may include such systems as paint spray booths and other situations where rotation and a quick insertion and removal of a workpiece are advantageous.

Figure 5:
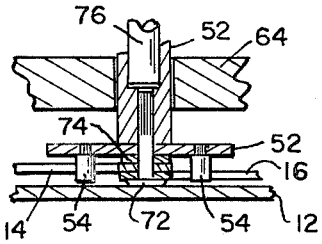
FIG. 5 is a partial cross-sectional view of the fastener mechanism shown in FIG. 1, taken along lines 5—5 as employed in the apparatus shown in FIG. 4 to show its manner of rotatable retention in the FIG. 4 apparatus.

FIG. 5 illustrates one way in which the fastener mechanism 10 shown in FIG. 1 may be coupled to a motor 70 as further shown in FIG. 4. The hub 52 will typically have been bored to receive and engage a press-fitted shaft 72 which protrudes through first and second arm members 14 and 16, respectively, and a washer 74 before being imbedded in the hub 52. Furthermore, the hub 52 will have been bored to receive and engage the drive shaft 76 of the motor 70 such that rotation of the drive shaft 76 of motor 70 causes a corresponding rotation of hub 52 and therefore a corresponding rotation of fastener mechanism 10.

What is claimed is:

1. A rotatable mechanism comprising an inner pair of arms pivotally connected adjacent their centers;

a first pair of outer arms pivotally connected together at their one ends and with their other ends each pivotally interconnected to one of the ends of each of the inner arms;

a second pair of outer arms pivotally connected together at their one ends and with their other ends each pivotally interconnected to one of the other ends of each of the inner arms;

a pair of work engaging means carried at the pivotal interconnections of the first pair and the second pair of outer arms, the pivotal connections of the inner arms and outer arms permitting expansion and contraction of the interval between the work engaging means; and means to urge contraction of the interval between the work engaging means so that work may be placed in the fastener by engaging one of work engaging means with one part of the work and expanding the interval between the work engaging means until the work can be engaged by the other work engaging means and upon contraction of the interval between the work engaging means to retain the work in the mechanism.

2. A mechanism comprising a plurality of arms pivotally connected together in lazy tong configuration and carrying a pair of work engaging means capable of a variably spaced interval by expansion and contraction of the mechanism, and means urging the mechanism to the contracted position and applying a gripping force to the work engaging means when the interval therebetween is expanded, each work engaging means including a base portion pivotally mounted to said arms at opposed extremities and at least two fingers extending angularly from the base portion, one finger for engaging and retaining workpieces of various thicknesses, and another finger for limiting the spaced interval in the contracted position.

3. Apparatus for washing a workpiece comprising a compartment within which the workpiece is situated for washing, means for providing a liquid spray, means for sealing said compartment, a rotatable mechanism for holding said workpiece carried within said compartment and including a plurality of arm members connected together to permit expansion and contraction of the mechanism and carrying workpiece retaining means capable of a variably spaced interval by such expansion and contraction, said arm members including first and second inner arm members pivotally coupled to each other at their respective centers, said first inner arm member having pivotally coupled to each of its ends third and fourth outer arm members and said second inner arm member having pivotally coupled to each of its ends fifth and sixth outer arm members, said third and fifth outer arm members and said fourth and sixth outer arm members respectively being pivotally connected together at their outer ends, and means for rotating said mechanism whereby said liquid spray is uniformly applied to various portions of said workpiece.

4. Apparatus as recited in claim 2 wherein said workpiece retaining means includes at least two work engaging means situated at the extremities of said outer arm members to hold said workpiece and means coupled to said arm members to urge said work engaging means inwardly toward each other, thereby retaining said workpiece, said mechanism automatically centering said workpiece about its axis of rotation.

5. Apparatus as recited in claim 4 wherein said work engaging means includes a base portion pivotally mounted to said outer arm members and at least one finger extending from said base for engaging and retaining said workpiece.

6. Apparatus as recited in claim 5 wherein said fingers extends angularly from said base portion of said grips for engaging and retaining workpieces of various thicknesses.

7. Apparatus as recited in claim 3 wherein said rotating means includes a rotatable hub supporting said arm members having drive means associated therewith for engaging said arm members, whereby said workpiece is rotated.

8. A mechanism for holding a workpiece comprising a plurality of arm members pivotally coupled for expansion and contraction by scissoring movement and means coupled to said arm members for retaining said workpiece in response to contraction of the mechanism by said scissoring movement, said retaining means including at least two work engaging grips rotatably situated at outer extremities of said arm members, said work engaging grips including means for limiting rotation thereof with respect to said arm members to self-align and self-center said work engaging grips after each workpiece is removed.

9. The mechanism as recited in claim 8 wherein said work retaining means further includes means coupled to said arm members for restraining movement of said arm members while holding said workpiece.

10. The mechanism as recited in claim 9 wherein said work restraining means includes at least one tension spring for biasing said grips inwardly towards each other, thereby forcing said grips to engage said workpiece.

11. The mechanism as recited in claim 9 wherein a first and a second arm member are pivotally coupled to each other at their respective centers, said first arm member having pivotally coupled to each of its ends, a third and a fourth arm member, and said second arm member having pivotally coupled to each of its ends a fifth and a sixth arm member, said third and fifth arm members and said fourth and sixth arm members respectively being pivotally connected together at their outer ends.

12. The mechanism as recited in claim 11 wherein said third, fourth, fifth, and sixth arm members have lengths which are less than the lengths of said first and second arm members.

13. The mechanism as recited in claim 11 wherein one of said work engaging grips is pivotally mounted at said pivotally connected outer ends of said third and fifth arm members and the other of said work engaging grips is pivotally connected at such pivotally connected outer ends of said fourth and sixth arm members, whereby said tension spring biases said work engaging grips inwardly towards each other in response to said restraining means.

14. The mechanism as recited in claim 8 wherein said arm members are supported by a rotatable hub having means for engaging said arm members, whereby said mechanism is caused to rotate for accessibility to various portions of said workpiece.

15. The mechanism as recited in claim 14 wherein said hub is rotatably driven by a motor and includes at least two drive posts which engage said arm members.

16. The mechanism as recited in claim 8 wherein said work engaging means includes a base portion pivotally mounted to said arm members and at least one finger extending from said base for engaging and retaining said workpiece.

17. The mechanism as recited in claim 16 wherein said finger extends angularly from said base portion of said work engaging means for engaging and retaining workpieces of various thicknesses.

* * * * *

UNITED STATES PATENT AND TRADEMARK OFFICE

CERTIFICATE OF CORRECTION

PATENT NO. : 4,236,542

DATED : December 2, 1980

INVENTOR(S) : Charles E. Fishburn

It is certified that error appears in the above-identified patent and that said Letters Patent are hereby corrected as shown below:

Column 4, line 25, change "include" to -- includes --.

Column 7, line 3, (Claim 4, line 1) change "2" to -- 3 --.

Column 7, line 16, (Claim 6, line 1) change "fingers" to -- finger --.

Signed and Sealed this

*Seventh* Day of *April 1981*

[SEAL]

*Attest:*

RENE D. TEGTMEYER

*Attesting Officer* *Acting Commissioner of Patents and Trademarks*